US006739323B2

(12) United States Patent
Tippmann, Jr.

(10) Patent No.: US 6,739,323 B2
(45) Date of Patent: May 25, 2004

(54) FEED MECHANISM FOR PAINT BALL GUN

(75) Inventor: Dennis J. Tippmann, Jr., Fort Wayne, IN (US)

(73) Assignee: Tippmann Pneumatics, Inc., Fort Wayne, IN (US)

( * ) Notice: Subject to any disclaimer, the term of this patent is extended or adjusted under 35 U.S.C. 154(b) by 0 days.

(21) Appl. No.: 10/205,276

(22) Filed: Jul. 25, 2002

(65) Prior Publication Data

US 2003/0127084 A1 Jul. 10, 2003

Related U.S. Application Data

(60) Provisional application No. 60/345,249, filed on Jan. 4, 2002.

(51) Int. Cl.[7] ..... F41B 11/02

(52) U.S. Cl. ..... 124/51.1; 124/48; 124/49; 124/73

(58) Field of Search ..... 124/48, 49, 51.1, 124/73, 74

(56) References Cited

U.S. PATENT DOCUMENTS

| | | | | |
|---|---|---|---|---|
| 5,505,188 A | * | 4/1996 | Williams | |
| 5,722,383 A | | 3/1998 | Tippmann, Sr. et al. | |
| 5,816,232 A | | 10/1998 | Bell | |
| 6,109,252 A | * | 8/2000 | Stevens | 124/51.1 |
| 6,213,110 B1 | * | 4/2001 | Christopher et al. | 124/51.1 |

* cited by examiner

*Primary Examiner*—John A. Ricci
(74) *Attorney, Agent, or Firm*—Barnes & Thornburg

(57) ABSTRACT

A paint ball gun is provided. The paint ball gun has a paint ball feed mechanism which comprises an actuator, a paint ball advance assembly, a bias member, and a paint ball feed assembly. The actuator is configured to advance such that the paint ball advance assembly, coupled to the actuator, moves in response to movement by the actuator. The paint ball feed assembly is coupled to the paint ball advance assembly moving therewith and engaging a paint ball to feed the same into the paint ball gun.

56 Claims, 11 Drawing Sheets

FEED MECHANISM FOR PAINT BALL GUN

RELATED APPLICATIONS

The present application is related to and claims priority to U.S. Provisional Patent Application, Serial No. 60/345,249, filed on Jan. 4, 2002, entitled AUTOMATIC FEED MECHANISM FOR PAINT BALL GUN. The subject matter disclosed in that provisional application is hereby expressly incorporated into the present application.

TECHNICAL FIELD

The present invention relates to paint ball guns and, more particularly, to paint ball feed mechanisms that automatically feed paint balls or markers into the firing chamber of a paint ball or marking gun.

BACKGROUND AND SUMMARY

Ammunition power feed mechanisms supply projectiles, in this case paint balls or markers, into the chamber or firing mechanism of a paint ball or marking gun for firing. Specifically, such ammunition power feed mechanisms positively feed or deposit a projectile into the chamber without the need for manual intervention. Semi-automatic and fully-automatic paint ball guns are the type that use such feed mechanisms. It would, therefore, be beneficial to provide a paint ball or marking gun with an automatic feed mechanism that deposits a paint ball or marker into the firing chamber.

Additionally, malfunctions of these feed mechanisms, however, can significantly reduce the firing rate, effectiveness, and reliability of the paint ball gun. In particular, misfeeds, such as a projectile only partially loading into the gun chamber, may cause the gun to "jam" and require the chamber to be manually cleared before reuse. This, of course, is a time consuming process. Furthermore, such misfeeds may cause damage to the gun. Ammunition power feed mechanisms, therefore, should be reliable and convenient to use.

Accordingly, an illustrative embodiment disclosed herein provides a paint ball gun. The paint ball gun comprises an actuator, a paint ball advance assembly, a bias member, and a paint ball feed assembly. The actuator is coupled to the paint ball gun and is configured to advance in coordination with the paint ball gun being fired. The paint ball advance assembly is coupled to the actuator and moves in response to movement of the actuator. The bias member is engageable with the actuator to create a return force on the actuator. The return force moves the actuator opposite the direction of the advance. The paint ball feed assembly is in operable communication with the paint ball advance assembly which engages the paint ball to feed the paint ball into the paint ball gun. This occurs when the bias member moves the advance opposite the advance to move the paint ball advance assembly.

Other illustrative embodiments may include the engaging member extending from the paint ball gun which is caused to move by firing the paint ball gun. The engaging member may also be engageable with the actuator to advance same as the engaging member moves. The paint ball feed assembly may comprise a priming member that is attached to the paint ball advance assembly. The paint ball feed assembly may also comprise a load member assembly which may be attached to the paint ball advance assembly such that the load member assembly loads a paint ball into the paint ball gun. The load member assembly may comprise a plurality of spaced-apart, coaxially-aligned extending members. The paint ball advance assembly may be a ratchet assembly. The ratchet assembly may comprise a wheel in communication with the paint ball feed assembly, a first pawl to communicate motion from the actuator to the wheel, and a second pawl to selectively prevent motion of the wheel.

Another illustrative embodiment of the paint ball gun disclosed herein provides a chamber, a piston, a spring member, a fluid source, a reciprocating lever, a wheel, a spring pawl, and a paint ball guide member. The chamber is attached to the paint ball gun. The piston is disposed in the chamber. The spring member is in communication with the piston to bias the piston in a first direction. The fluid source provides a force against the piston in a second direction that opposes the first direction. The reciprocating lever is coupled to the piston, and comprises a pawl. The wheel has a plurality of teeth disposed thereon configured to receive the pawl of the reciprocating lever such that as the piston moves in the second direction the pawl engages one of the plurality of teeth to cause the wheel to rotate in a first rotational direction. The spring pawl engages another of the plurality of teeth to prevent rotation of the wheel in a second rotational direction, which is opposite the first rotational direction, when the piston is moving in the second direction. The paint ball guide is configured to feed a paint ball into the paint ball gun. The fluid from the fluid source enters the chamber, moving the piston in the second direction, causing the pawl of the reciprocating lever to engage one of the plurality of teeth of the wheel. The bias of the spring member moves the piston in the first direction such that the engagement between the pawl and one of the plurality of teeth moves the wheel in the first rotational direction to cause the guide member to move to feed the paint ball into the paint ball gun.

Another illustrative embodiment of the paint ball gun comprises a chamber, a piston, a ratchet mechanism, a coupling member, and a paint ball guide member. The chamber is attached to the paint ball gun. The piston is disposed in the chamber and is movable within the chamber in first and second directions, wherein the second direction is opposite the first direction. The ratchet mechanism is in communication with the piston. The coupling member extends from and is coupled to the ratchet mechanism. The paint ball guide member is coupled to the coupling member, wherein the paint ball guide is configured to feed a paint ball into the paint ball gun. A force acts on the piston to move same in the second direction to engage the ratchet mechanism. After depletion of the force, the piston moves in the first direction to cause the paint ball guide member to move and feed the paint ball into the paint ball gun.

Other illustrative embodiments may include the paint ball guide member comprising a priming member coupled to the coupling member. The paint ball guide member may also comprise a load member assembly. The load member assembly may comprise a plurality of spaced-apart paddles. The ratchet mechanism may comprise a wheel in communication with a paint ball feed assembly, a first pawl to communicate motion from the piston to the wheel, and a second pawl to selectively prevent motion of the wheel.

Another illustrative embodiment of the paint ball gun disclosed herein comprises a magazine and a ball guide member. The magazine is attached to the paint ball gun and is configured to contain at least one paint ball. The magazine is also in operable communication with a firing mechanism portion of the paint ball gun by an opening adjacent both the magazine and the firing mechanism. The ball guide member is coupled to and extends from the gun. The ball guide member extends into the magazine to direct the paint ball into the firing mechanism through the opening.

Other illustrative embodiments may include the magazine comprising a plurality of paddle assemblies and the assemblies being coaxially aligned. The magazine may comprise a plane flooring at its lowermost extent. The plurality of paddles may have a space between at least a pair of the plurality of paddles, wherein the space is configured to receive the ball guide member.

Another illustrative embodiment of the paint ball gun comprises an automatic paint ball feed mechanism comprising a magazine having a paddle wheel assembly configured to move at least one paint ball into the paint ball gun. The paddle wheel assembly comprises a plurality of coaxially-aligned paddle members such that each of the plurality of paddle members comprises at least two paddle blades. The paint ball gun also comprises a ball guide member that guides a paint ball moved by the paddle wheel assembly.

Other illustrative embodiments may include, the magazine comprising a plane flooring adjacent one of the plurality of paddle members. In addition, the plurality of paddle members may have a space between at least a pair of the plurality of paddle members such that the space is configured to receive the ball guide member.

Another illustrative embodiment of the paint ball gun comprises a misfed paint ball clearing apparatus. The paint ball clearing apparatus operates to clear a misfed paint ball in the paint ball gun by allowing the misfed paint ball to be deposited in the firing chamber of the paint ball gun. The misfed paint ball clearing apparatus comprises an advance assembly, an actuator, and a feed assembly. The motion of the actuator drives the advance assembly which causes concurrent movement of the feed assembly. The concurrent movement of the feed assembly affects the misfed paint ball's position with respect to the paint ball gun to cause the misfed paint ball to deposit in the firing chamber of the paint ball gun.

Other illustrative embodiments may include the actuator further comprising a piston arm; the advance assembly being a ratchet system; the ratchet system comprising a wheel having a plurality of notches disposed thereon, a pawl engageable with the wheel to rotate the wheel, and a stop selectively engageable with the wheel to prevent rotation of the wheel; the pawl further comprising a tooth that extends from the pawl; at least one of the plurality of notches having a detent disposed therein; the tooth selectively engaging the detent; the feed assembly further comprising at least one paddle which affects the misfed paint ball's position with respect to the paint ball gun to cause the misfed paint ball to deposit in the firing chamber of the paint ball gun; a trigger mechanism that selectively engages the actuator to initiate motion of the actuator; motion of the actuator being in a first linear direction, and concurrent movement of the feed assembly being in a first rotational direction; concurrent movement of the feed assembly in the first rotational direction affecting the misfed paint ball's position with respect to the paint ball gun; and a movement of the feed assembly being in a second rotational direction causing the misfed paint ball to deposit in the firing chamber of the paint ball gun.

Another illustrative embodiment of the paint ball gun provides a misfed paint ball clearing apparatus comprising a container and an extending member. The container is positioned adjacent an opening disposed in the paint ball gun. The opening provides operable communication between the container and an interior portion of the paint ball gun. The extending member is positioned within the container. The extending member is also movable in a first direction to affect a paint ball's position relative to the container, wherein the paint ball would otherwise be prevented from entering the opening disposed in the paint ball gun. The extending member is further movable in a second direction to deposit the paint ball into the opening disposed in the paint ball gun.

Other illustrative embodiments may include the first direction in which the extending member is movable being a first rotational direction; the second direction in which the extending member is movable being a second rotational direction; the first and second rotational directions being opposed directions; and the extending member engaging the paint ball which is misfed relative to the opening to move the paint ball to another position relative to the container, and re-engage the paint ball to deposit the paint ball into the opening.

Another illustrative embodiment of the paint ball gun provides a method for clearing a misfed paint ball in a paint ball gun wherein the paint ball is misfed relative to a feed mechanism attached to the paint ball gun. The method for clearing the misfed paint ball comprises the steps of powering an actuator, engaging the advance assembly, driving the feed mechanism, and clearing the misfed paint ball. Engaging the advance assembly by the actuator causes the advance assembly to move. Driving the feed mechanism is accomplished by engagement with and movement of the advance assembly. Clearing the misfed paint ball is achieved by driving the feed mechanism which affects a positional adjustment of the misfed paint ball relative to the firing chamber to reposition the paint ball to a location that allows the misfed paint ball to be deposited into the firing chamber.

Other illustrative embodiments may include the steps of activating a trigger mechanism to initiate powering of the actuator; moving the advance assembly in a first direction; moving the feed mechanism in the first direction concurrently with moving the advance assembly in the first direction; affecting the positional adjustment of the misfed paint ball by moving the feed mechanism in the first direction, wherein the misfed paint ball is repositioned to a location that allows the misfed paint ball to be deposited into the firing chamber; moving the advance assembly in a second direction; moving the feed mechanism in the second direction concurrently with moving the advance assembly in the second direction; and moving the misfed paint ball that is able to enter the firing chamber by moving the feed assembly in the second direction, and depositing the misfed paint ball into the firing chamber.

Another illustrative embodiment of the paint ball gun also provides a method for clearing a misfed paint ball in a paint ball gun which comprises the steps of: activating a trigger mechanism; powering an actuator to cause linear movement of the same by activation of the trigger mechanism; engaging an advance assembly by the linear movement of the actuator; rotating a portion of the advance assembly by translating the linear movement of the actuator into rotational movement; and clearing the misfed paint ball by rotating the feed assembly concurrently with rotating the advance assembly which affects a positional adjustment of the misfed paint ball relative to the firing chamber to reposition the paint ball to a location that allows the misfed paint ball to be deposited into the firing chamber.

Other illustrative embodiments may include the steps of rotating the wheel in a reverse direction by the tooth which engages the detent. Additionally, these other illustrative embodiments may include the advance assembly being a ratchet assembly; the ratchet assembly comprising a wheel having a plurality of notches disposed thereon, a pawl engageable with at least one of the notches disposed on the wheel to effect rotation of the wheel, and a stop selectively engageable with the wheel to selectively prevent rotation of the wheel; the pawl selectively engaging at least one of the plurality of notches to rotate the wheel in a forward direction; the pawl further comprising a tooth that extends from the pawl; at least one of the plurality of notches having a detent disposed therein; the tooth selectively engaging the detent; the reverse direction being opposite the forward direction; rotation of the wheel in the forward direction causing movement of the feed assembly in the forward direction which affects a positional adjustment of the misfed paint ball relative to the firing chamber to reposition the paint ball to a location that allows the misfed paint ball to be deposited into the firing chamber; and rotation of the wheel in the reverse direction causing movement of the feed assembly in the reverse direction to deposit the paint ball into the firing chamber.

Additional features and illustrative embodiments of this disclosure will become apparent to those skilled in the art upon consideration of the following detailed description exemplifying the best mode of carrying out the invention as presently perceived.

DESCRIPTION OF DRAWINGS

The disclosure herein will be described hereafter with reference to the attached drawings which are given as non-limiting examples only, in which.

Corresponding reference characters indicate corresponding parts throughout the several figures. The exemplification set out herein illustrates best mode embodiments of the invention, however, such exemplification is not to be construed as limiting the scope of the invention in any manner.

DETAILED DESCRIPTION OF THE DRAWINGS

Figure 1:
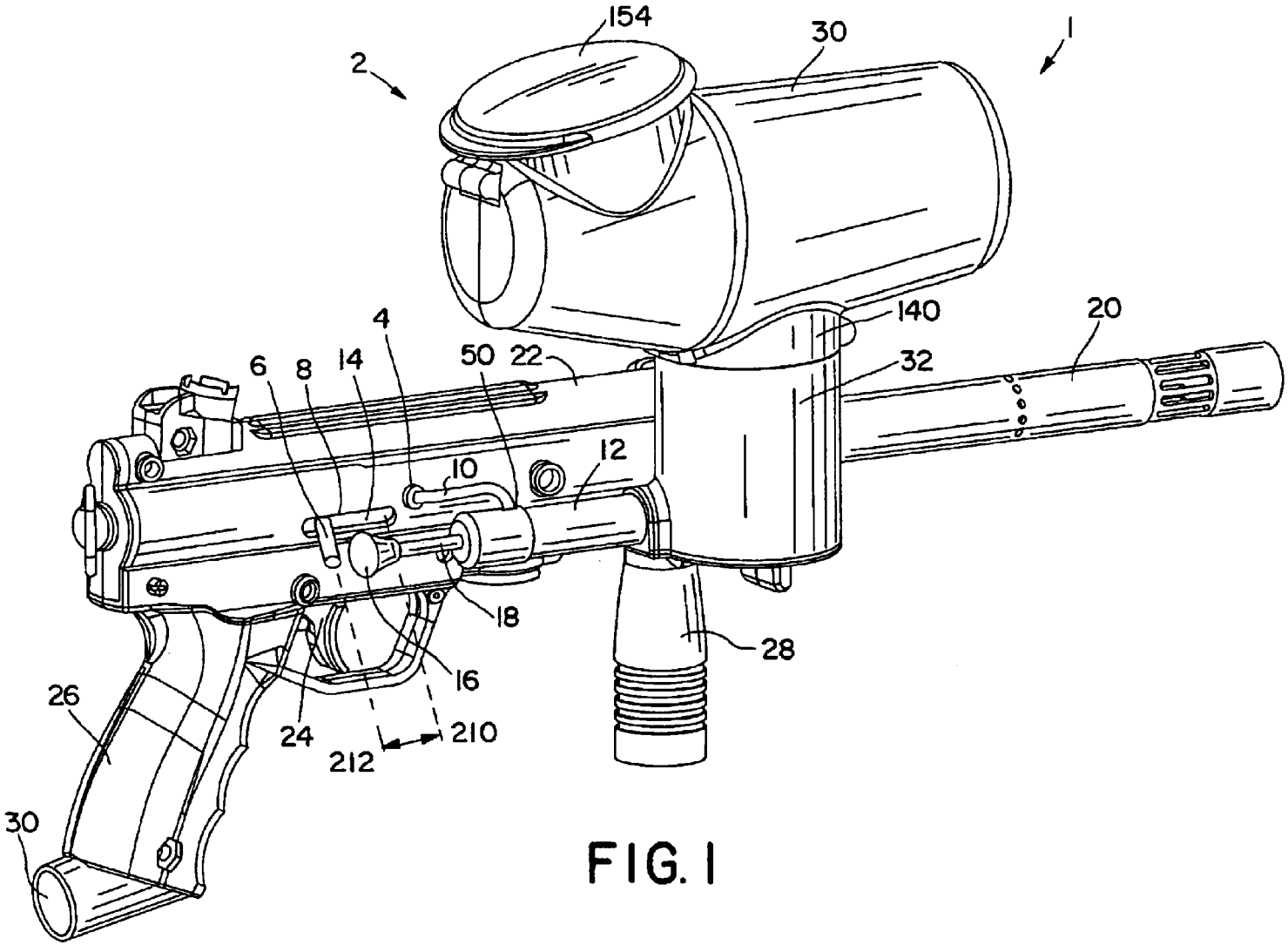
FIG. 1 is a perspective view of a paint ball gun with an illustrative embodiment of a feed mechanism attached thereto.
Figure 2:
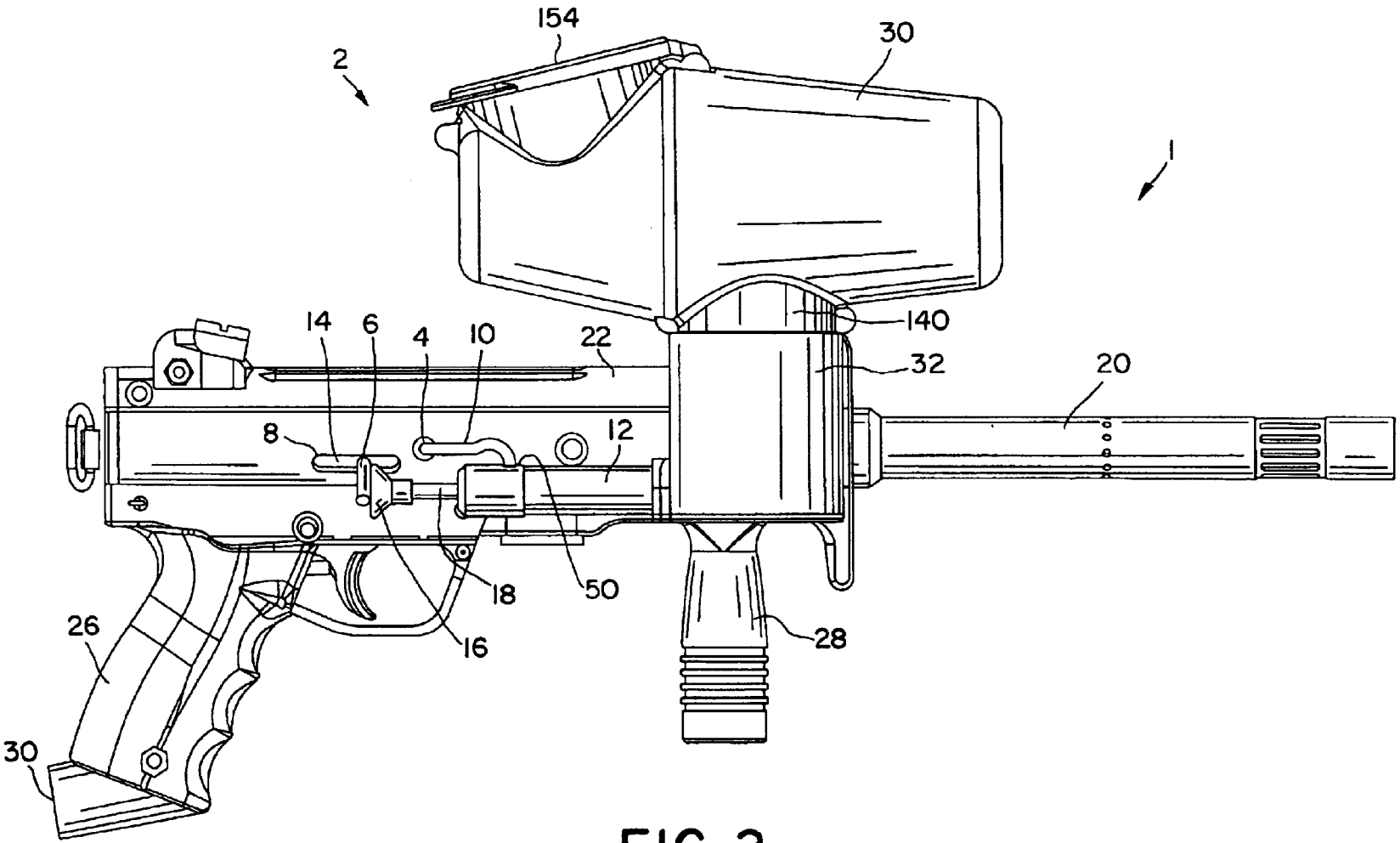
FIG. 2 is a side view of the paint ball gun and the feed mechanism of FIG. 1.

A perspective and side view of a paint ball gun 1, with an illustrative embodiment of a feed mechanism 2 attached thereto, is shown in FIGS. 1 and 2, respectively. Gun 1 can be a paint ball gun or a marking gun of any variety that comprises a fluid-actuated firing mechanism. In the illustrated embodiment, gun 1 also comprises an air port 4 and a reciprocating handle 6. A tube 10 extends from air port 4 leading into cylinder 12 operatively communicating with a firing chamber 17 (see FIG. 8) inside gun 1 to cylinder 12. Reciprocating handle 6 is attached to a cylindrically reciprocating member 14 located in the firing chamber 17 and extends through slot 8. Reciprocating handle 6 is configured to move reciprocally within slot 8. In one illustrative embodiment, reciprocating handle 6 and slot 8 are aligned with strike pad 16 located at the end of rod 18 which extends into cylinder 12, as further discussed herein. The paint ball gun 1, itself, is illustratively conventional, comprising a barrel 20, body 22, trigger 24, and grip handles 26, 28.

Figure 3:
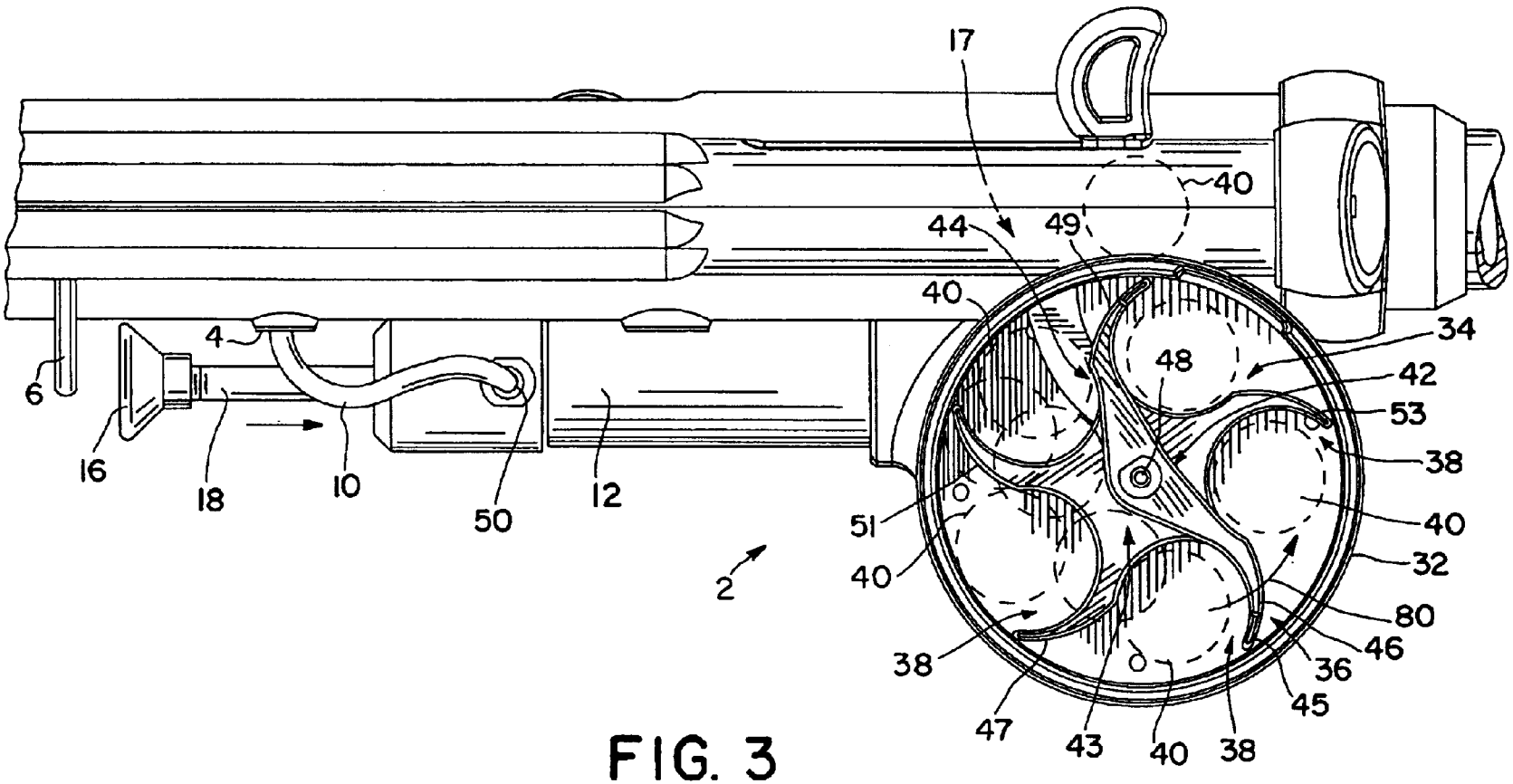
FIG. 3 is a top view of a portion of the feed mechanism of FIG. 1.
Figure 7:
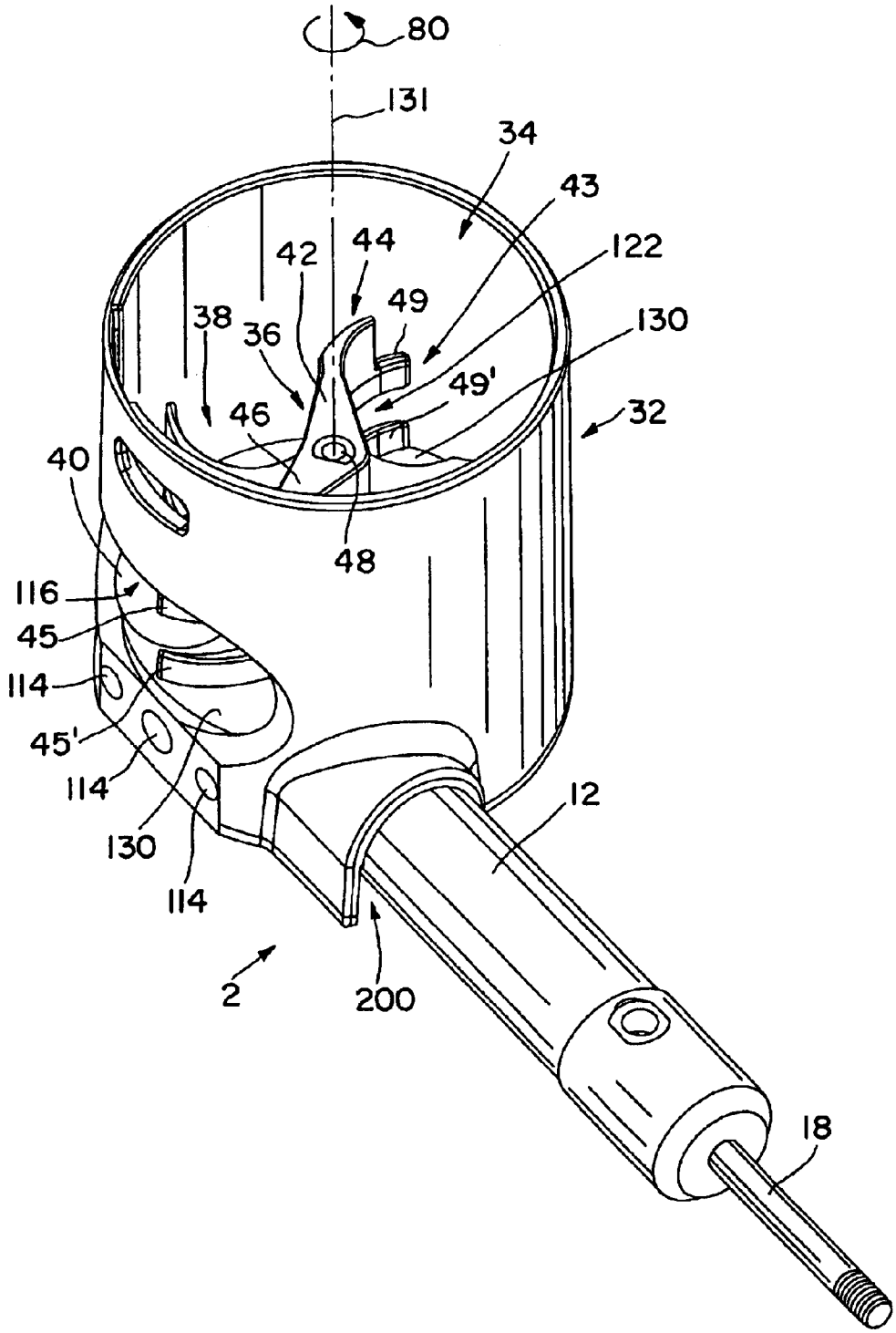
FIG. 7 is a perspective view of the feed mechanism of FIG. 1.
Figure 9:
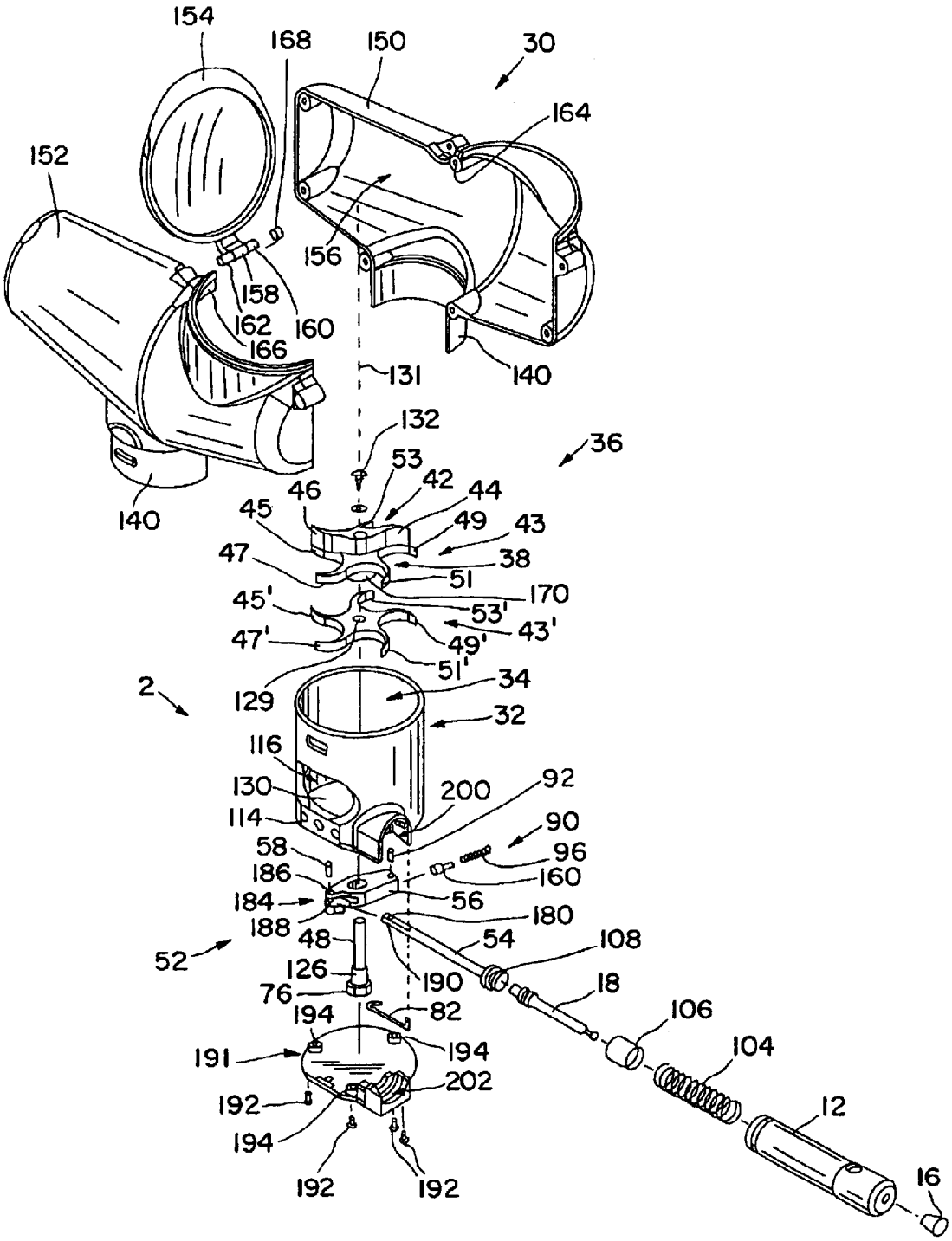
FIG. 9 is an exploded perspective view of the feed mechanism.

Feed mechanism 2 further comprises a hopper 30 attached to magazine 32, both of which house a plurality of paint balls to be fed into firing chamber 17 of body 22. Cylinder 12 is shown extending into magazine 32. A top view of the feed mechanism 2, with hopper 30 removed, is shown in FIG. 3. The illustrated embodiment comprises the magazine 32 having a cavity 34 disposed therein. A ball carrier assembly 36 is shown dividing the cavity 34 into several defined spaces 38, each sized to receive a paint ball 40 (shown in phantom). In the illustrated embodiment, assembly 36 comprises two types of sub-assembly ball carriers, a priming carrier, and a feed carrier. The carriers are generally defined by a hub having a plurality of radiating arms which form the plurality of defined spaces 38. The first carrier is a priming carrier 42 having two radiating paddles 44, 46. As depicted in FIGS. 7 and 9, priming carrier 42 is illustratively the uppermost carrier of the assembly 36, and the first to begin organizing paint balls 40 into the spaces 38 as they are gravitatively deposited therein from hopper 30. Priming carrier 42 is attached to an axle 48 and rotates in direction 80, which allows a limited number of paint balls 40, housed in the hopper 30 and magazine 32 located above assembly 36, to reposition themselves above spaces 38 so that as one paint ball 40 moves from a space 38 to chamber 17, another paint ball 40 will move into that empty space 38 automatically.

As defined further herein, feed carrier 43 is a dual member carrier located below the priming carrier 42. (See reference numbers 43 and 43' in FIGS. 8 and 9.) Feed carrier 43, illustratively, comprises five paddles 45, 47, 49, 51, 53 which collectively define the spaces 38 of carrier 43. Illustratively, the paddles 45, 47, 49, 51, 53 are complementarily arcuate relative to the paint balls 40 to assist directing same into the firing chamber 17. Illustratively, one paint ball 40 is positioned within one space 38 between each pair of paddles to deposit the paint ball 40 into firing chamber 17.

Also shown in FIG. 3 is cylinder 12 and its communication with chamber 17 via tube 10 leading into port 50 of cylinder 12. It is contemplated that a portion of fluid, like compressed air, that conventionally enters the firing chamber 17 to propel paint ball 40, will bleed from air port 4 through tube 10 and into cylinder 12 to move the assembly 36, as discussed further herein.

Figure 4:
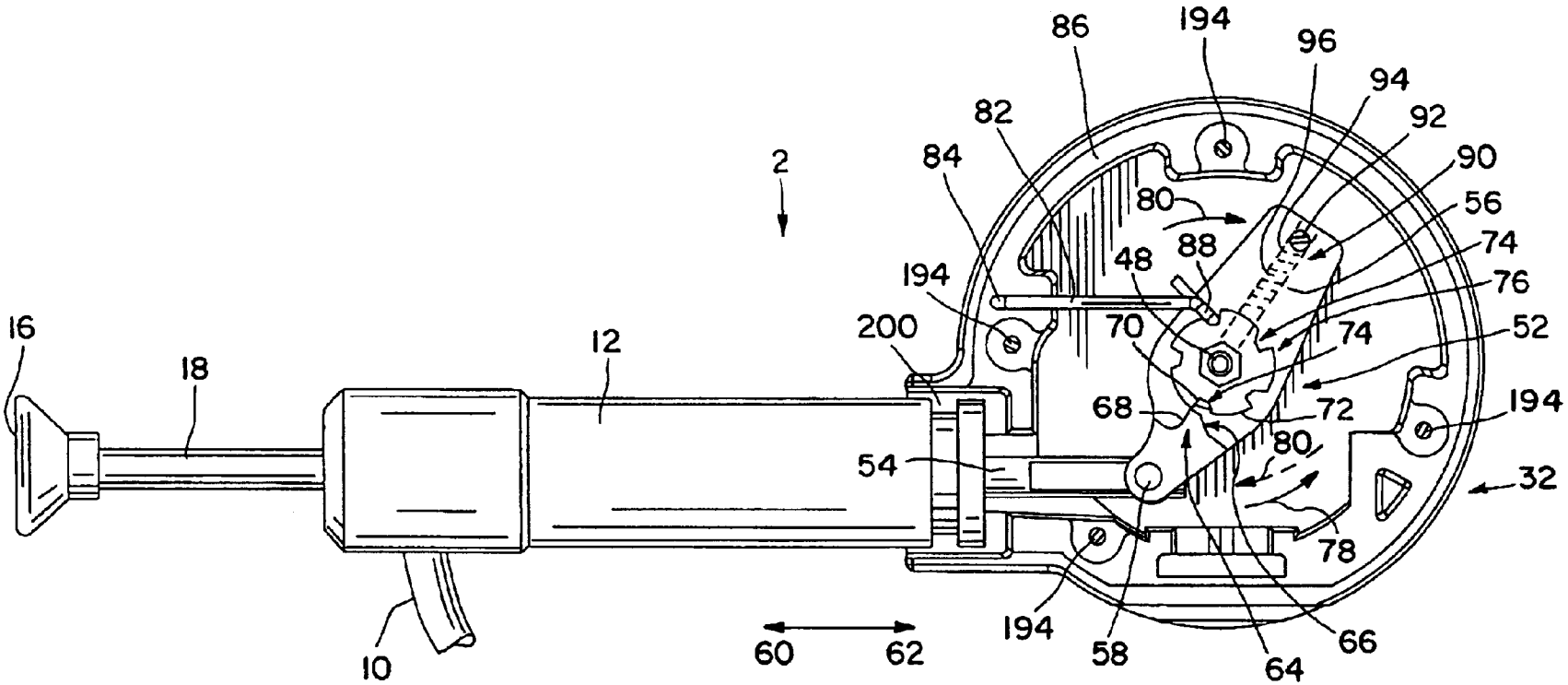
FIG. 4 is a bottom view of the feed mechanism of FIG. 1.

An advance assembly 52 is shown in the bottom view of the feed mechanism 2 in FIG. 4. In the illustrated embodiment, assembly 52 is illustratively that of a ratchet-like apparatus comprising a rod 54 extending from cylinder 12, and attached to a rotating base member 56 by a pivot member 58. Pivot member 58 allows rod 54 to cause base member 56 to rotate about axle 48, as rod 54 moves in either direction 60, 62. Base member 56 also comprises a pawl 64 located near the proximal end of member 56 relative to pivot member 58. Pawl 64 has a sloped surface 66 and an engaging surface 68 such that the sloped surface 66 does not engage surface 70 of notch 74 of wheel 76, but rather, illustratively slides past surface 72 while rod 54 moves in direction 62 during assembly 54's initial or forward stroke, and the base member 56 rotates in direction 78. Illustratively, engaging surface 68 of pawl 64 is configured to engage surface 70 of wheel 76 when base member 56 rotates in direction 80.

Assembly 52 comprises a spring rod 82 having a base portion 84 fixedly attached to lower periphery 86 of magazine 32, and having a pawl end 88 attached opposite base portion 84. Pawl end 88 is shown configured to engage one of the plurality of notches 74, particularly surface 70 of same. This engagement prevents wheel 76 from rotating in direction 78, particularly when member 56 moves in direction 78. The resulting effect is that as rod 54 moves in direction 62, it causes member 56 to rotate in direction 78 while pawl end 88 of spring rod 82 prevents wheel 76 from also rotating in direction 78. At the completion of the forward stroke in direction 62, as will be discussed in further detail here, rod 54 will make a return stroke, moving in direction 60. This return stroke in direction 60 causes engaging surface 68 of pawl 64 to engage surface 70 of a notch 74, causing the wheel 76 to rotate in direction 80. As will also be discussed further herein, the rotation of wheel 76 causes axle 48 to rotate concurrently. The rotation of axle 48 rotates ball carrier assembly 36 to positively feed a paint ball 40 from a space 38 into firing chamber 17 where the paint ball 40 is ready to be fired. (See, also, FIG. 3.)

Base member 56 also comprises a bias assembly 90 located distal to the pivot member 58 opposite of axle 48. Bias assembly 90 is configured to maintain a biased contact between pawl 64 and wheel 76, wherein pawl 64 is biased into one of the plurality of notches 74 during the return stoke in direction 60 of rod 54. Bias assembly 90 illustratively comprises a stop 92 located within a channel 94. A spring 96 is disposed in channel 94 with one end abutting stop 92, and the opposite end abutting a bearing member 100 (see FIG. 5). The bias of spring 96 biases bearing member 100 against axle 48 in direction 102. (See, also, FIG. 5.) The resulting effect is that pawl 64 of member 56 is drawn against wheel 76 so that as rod 54 moves in direction 60, and pawl 64 will be drawn into and engage notch 74, as previously discussed.

Figure 5:
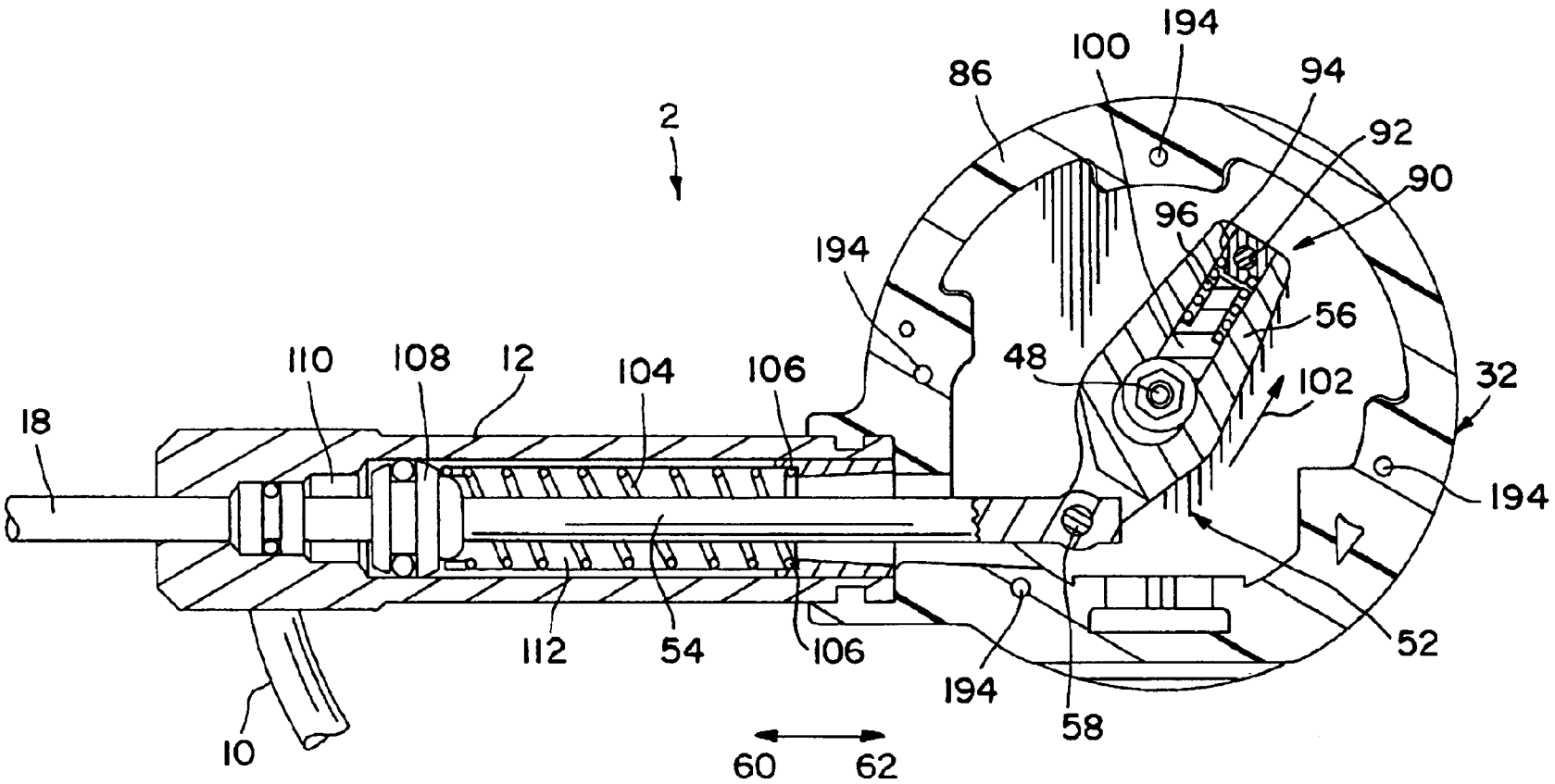
FIG. 5 is a bottom cross-sectional view of the feed mechanism of FIG. 1.

The advance assembly 52 and feed mechanism 2 is shown in a cross-sectional bottom view of magazine 32 in FIG. 5. A spring member 104 is located in cylinder 12 extending between a stop edge 106 and a piston 108. Piston 108 is attached to rod 54. In this illustrated embodiment, spring member 104 biases piston 108 in the return stroke direction 60, causing rod 54 to also move in the return stroke direction 60. It is appreciated that spring member 104 can be made of a spring steel, a resilient foam, a fluid-value apparatus, or any other like structure(s).

Piston 108 also divides cylinder 10 illustratively into two chambers 110, 112. Chamber 110 is the portion of cylinder 12 that is in communication with and receives fluid, illustratively, compressed air, from firing chamber 17. (See, also, FIG. 3.) Accordingly, when the fluid enters chamber 110, it seeks to occupy more space by moving piston 108 which causes the forward stroke of rod 54 in direction 62. The force of the fluid is contemplated to be greater than the bias force of spring 104, which causes spring 104 to compress during the forward stroke. After the force of the fluid is exhausted, however, the bias force of spring 104 provides a consistent force against the piston 108, which causes the piston to return stroke in direction 60. This causes movement of assembly 52 as previously discussed. In the illustrative embodiment, movement of assembly 52 moves feed mechanism 2 which causes a paint ball 40 to be positively fed into firing mechanism 17. (See, also, FIG. 3.) This embodiment employs the return stroke in direction 60, caused by spring member 104, with which to feed the paint ball 40, because it provides a smoother and consistent motion. It is contemplated, however, that the movement caused by the fluid or compressed air can also be used to feed the paint ball 40.

Figure 6:
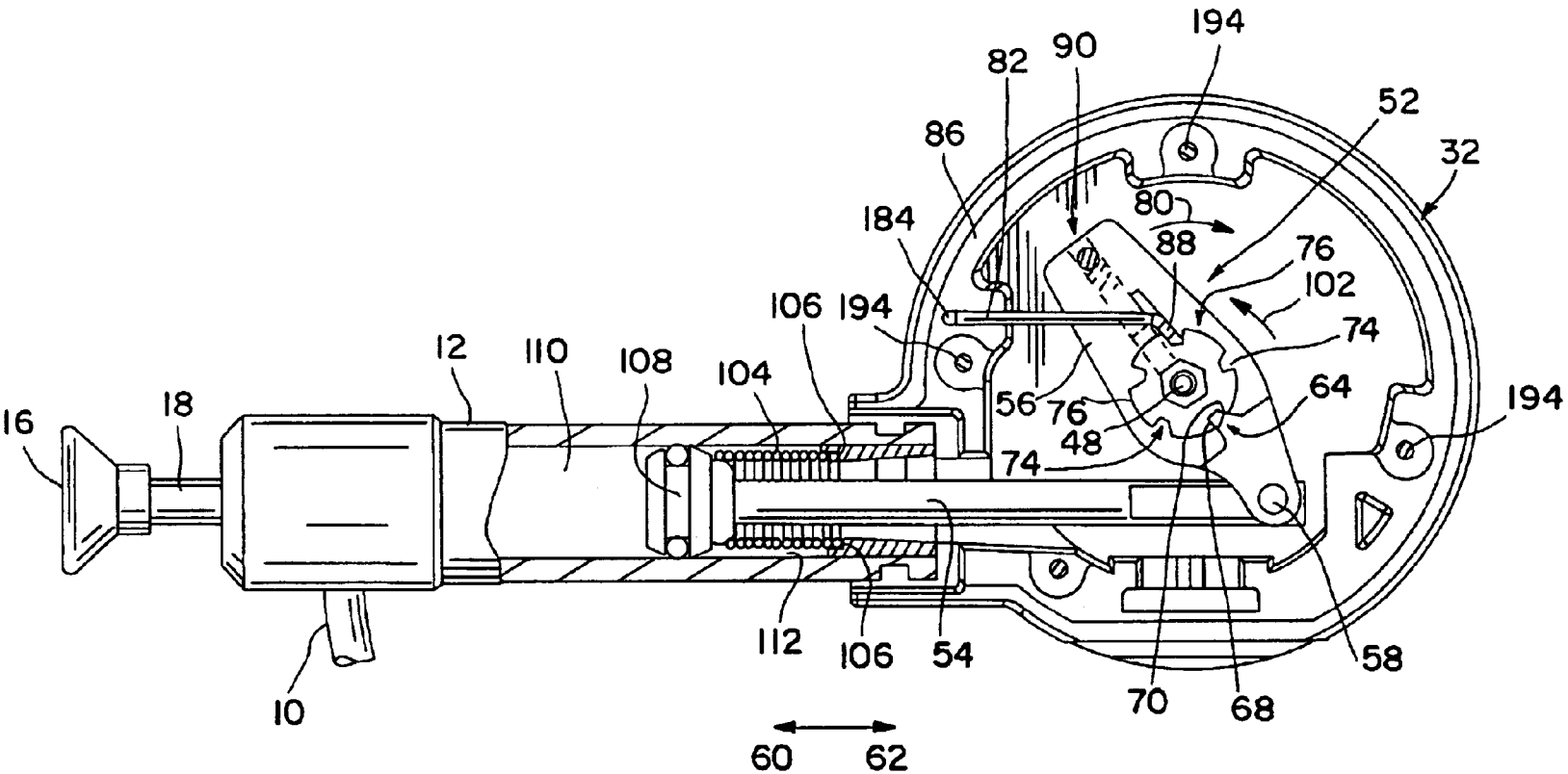
FIG. 6 is a partial cross-sectional bottom view of the feed mechanism of FIG. 1.

Actuation of assembly 52 is shown in another bottom view of assembly 2 in FIG. 6. Illustratively, the constructive end of the forward stroke of rod 54 is defined by the engagement of pawl 64 and notch 74. When the force from the fluid or manual exertion on piston 108 is exhausted, the bias from spring 104 causes movement of rod 54 in direction 60, as previously discussed, as well as the concurrent rotation of wheel 76 and base member 56 in direction 80. In this illustrative embodiment, it is contemplated that axle 48 is fixedly attached to wheel 76. Accordingly, when wheel 76 rotates in direction 80, so too does axle 48. Because assembly 42 (see FIG. 3) is attached to axle 48 (see FIG. 8), assembly 42 advances to allow a paint ball to enter firing chamber 17 after each firing of gun 1. It is appreciated that assembly 52 may be configured to accept other types of forces, or other types of bias members, like a resilient pad, for example, to actuate assembly 52.

Though assembly 52 has been described with particularity, it is has been done so only for clarity purposes. It is contemplated that other structures may be used in lieu of those described herein to perform the same function, way, and result, and it will be appreciated that those such structures are within the scope of this invention. Again, the specificity of detail outlined in this disclosure is not intended to be construed as limiting the scope of the invention.

A perspective view of assembly 2 is shown in FIG. 7. Specifically depicted in this view are the attachment bores 114, magazine opening 116, cavity 34, and carrier assembly 36. Illustratively, attachment bores 114 are shown disposed through the lower portion of magazine 32, and are configured to receive bolts or other fasteners (not shown) that attach the magazine 32 to gun 1. (See, also, FIGS. 1, 2, and 3.) Magazine opening 116 is a passageway between magazine cavity 34 and firing mechanism 17 of gun 1. When assembly 2 is attached to gun 1, opening 116 is contemplated to be located adjacent chamber opening 118. (See, also, FIG. 10.) This configuration allows carrier assembly 36 to feed a paint ball 40 through chamber opening 118 and into chamber 17 where it will be ready for firing. The perspective view in FIG. 7 also depicts the orientation of ball carrier 36 to ball 40 and cavity 34. As previously discussed, priming carrier 42 is attached to axle 48 and rotates in direction 80, allowing a limited number of paint balls 40 housed in the hopper and magazine above assembly 36 to position themselves above spaces 38 so that as one ball moves from a space 38 to chamber 17, another paint ball 40 will move into that empty space 38.

Figure 8:
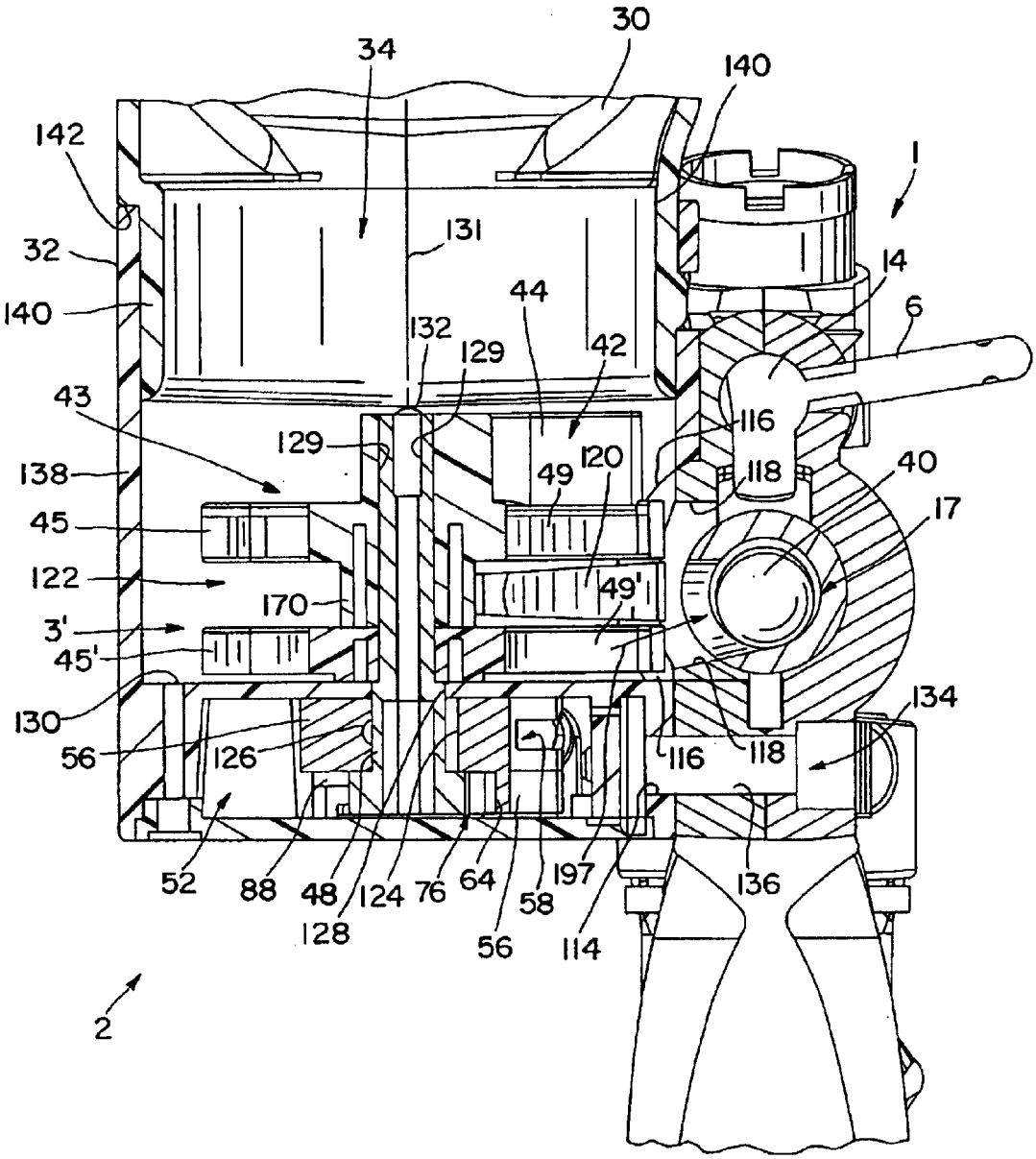
FIG. 8 is a front cross-sectional view of the gun and the feed mechanism of FIG. 1.

A cross-sectional view of magazine 32 and gun 1 is shown in FIG. 8. Specifically shown is the relationship between feed carrier 43 and hook guide 120. Feed carrier 43 comprises a channel 122 that illustratively bisects paddles 45, 47, 49, 51, 53. Channel 122 is so configured to receive hook guide 120, as illustratively shown in FIG. 8. Accordingly, as carrier 43 rotates a ball 40 within one of the spaces 38, ball 40 will engage hook guide 120, and the continued rotation of the paddles 45, 47, 49, 51, or 53 will urge ball 40 into firing chamber 17 through opening 116 of magazine 32 and the adjacent opening 118 of gun 1. It is contemplated that spaces 38 are sized by virtue of the position and shape of paddles 45, 47, 49, 51, 53, that each cycle of movement of rod 54 in directions 60 and 62 causes movement of feed carrier 43 and movement of one paint ball 40 into the firing chamber 17. In the illustrative embodiment, this is contemplated to occur after each firing of gun 1. It is further contemplated that mechanism 2 can be so configured that the ball can be deposited in the firing chamber on either the forward or return stroke.

The rotation of carriers 42 and 43 are made by the attachment of same to axle 48 which is attached to advance assembly 52. As illustrated in FIG. 8, axle 48 is disposed through wheel 76 and extends through a bore 124 of member 56. It is appreciated, however, that axle 48 may be an integrally formed part of wheel 76, or to some other structure, so long as the axle 48 is caused to move as wheel 76 moves. In the illustrated embodiment, a portion of axle 48 serves as a bearing surface 126 about which member 56 rotates, thus allowing same to move as part of the ratcheting process without necessarily causing axle 48 to move. Axle 48 is also disposed through an opening 128 in flooring 130 of magazine 32 and through the illustrative axis of rotation 131, as well as bore 129 of carriers 42, 43. Illustratively, a fastener 132 is disposed in the top of axle 48 to attach same to carriers 42, 43. Such attachment allows carriers 42, 43 to move concurrently with axle 48.

Further shown in FIG. 8 is fastener 134 which is disposed through bore 136 of gun 1 and bores 114 of magazine 32 for securing opening 116 of same adjacent to firing chamber 17. It is appreciated, however, that any variety of conventional means may be used to attach magazine 32 to gun 1. Additionally, the illustrated embodiment of FIG. 8 depicts upstanding wall 138 of magazine 32 receiving an opening in hopper 30 defined by a depending portion 140 for communication between magazine 32 and hopper 30. The depth of insertion of the depending portion 140 is limited by a shoulder 142 formed on hopper 30 adjacent depending portion 140. Shoulder 142 engages upstanding portion 138 to create a fit between the two structures. It is appreciated that upstanding portion 138 and depending portion 140 may be alternatively configured such that the upstanding portion comprises a shoulder which limits the depth of insertion of the depending portion of the hopper, essentially the reverse of what is shown in FIG. 8.

An exploded view of automatic feed mechanism 2 is shown in FIG. 9. The illustrated embodiment comprises the hopper 30 having two halves 150, 152, defining a cavity 156 within which paint balls are stored. A cover 154 is hingedly attached to each half 150, 152 via hinge 158 having extending portions 160, 162, each disposed in one of the bores 164, 166 of halves 150, 152, respectively. Cover 154 is also illustratively biased by a spring member 168 to maintain cover 154 in the closed position, but for loading of the paint balls. Also shown in regards to hopper 30 are the depending members 140. The illustrative embodiment of ball carrier assembly 36 is shown as a two-structure unit having the primer carrier 42 integrally formed with a first portion of feed carrier 43. In this illustrated embodiment, the second portion 43' of the feed carrier is separated from the first portion by a partition 170 that creates the spacing necessary to form the cavity 122 as shown in FIG. 8. Feed portion 43' of the feed carrier is shown having a portion of bore 129, which is coaxial to all of the other portions of bore 129 disposed through assembly 36. Carriers 42, 43, 43' are all received in cavity 34, and are pivotable about the axis of rotation 131 in a manner previously disclosed. (See also FIG. 8.)

An exploded view of advance assembly 52 is also shown in FIG. 9. The individual components of assembly 52, previously discussed, are shown such as rod 54, base member 56, pivot member 58, axle 48, spring rod 82, bias assembly 90, piston 108, rod 18, and cylinder 12. In the illustrated embodiment, rod 54 comprises a bore 180 transversely disposed at one end 190 with respect to the length of the rod opposite the piston 108. End 190 is disposed through an illustrative slot 184 disposed in member 56, and bore 180 is positioned coaxial to bores 186, 188 through which pivot member 58 extends to allow rod 54 to pivot thereabout. Also in the illustrative embodiment, axle 48 is shown integral to wheel 76. A cover plate 191 covers the bottom of magazine 32, enclosing advance assembly 52 between same and flooring 130. Cover plate 191 attaches to magazine 32 via a plurality of fasteners 192 that attach to bores 194 disposed through the lower periphery 86 of magazine 32. (See also FIG. 4.) Portions of receiving bores 200, 202 are disposed through magazine 32 and cover plate 191, respectively, forming a complete bore sized to receive cylinder 12. It is appreciated, that the precise illustrations of the aforementioned structures are for clarity purposes, and modifications to same can be made while remaining within the scope of the invention.

Figure 10:
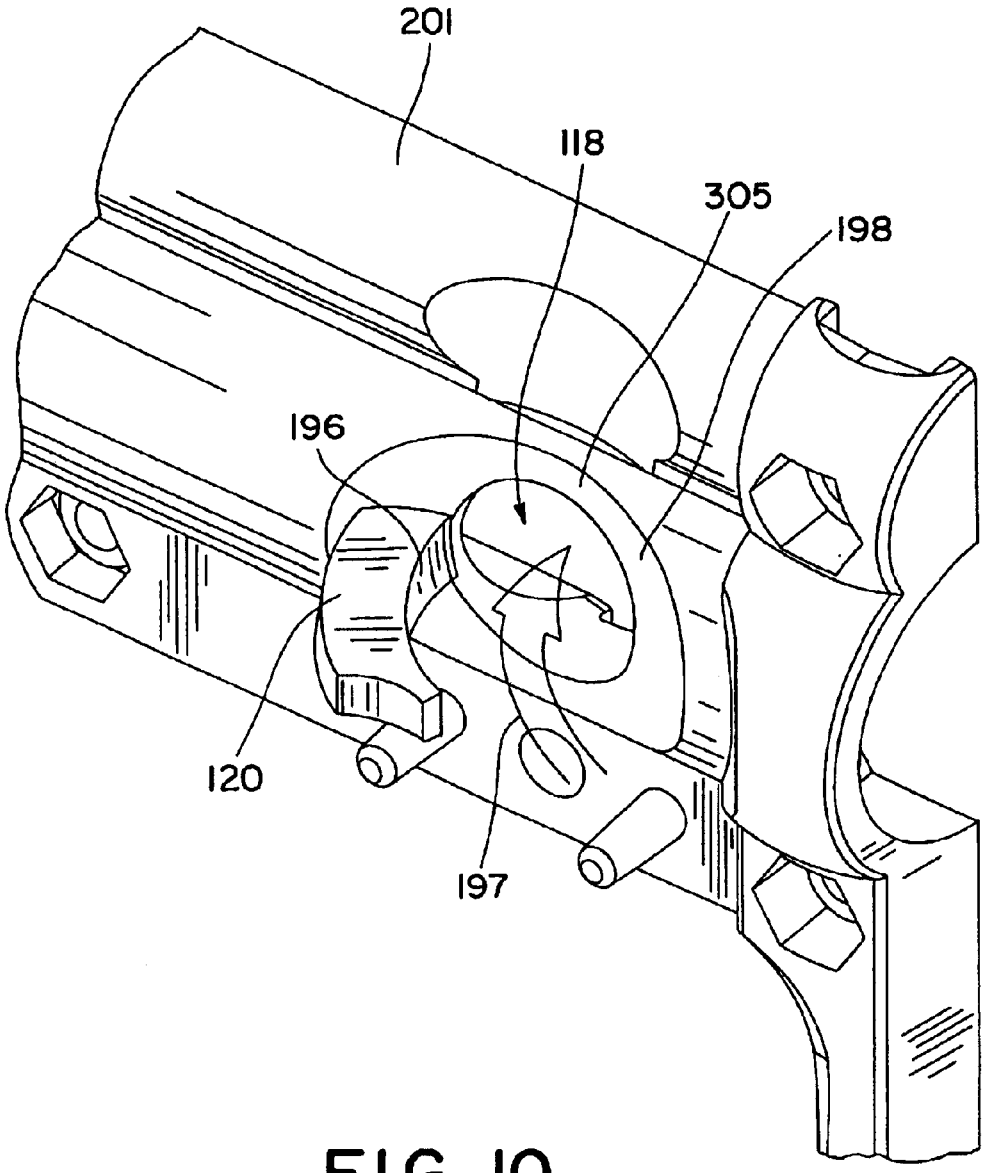
FIG. 10 is a perspective view of a portion of the gun showing the hook guide blade.

A perspective view of hook guide 120 is shown in FIG. 10. The illustrative embodiment of hook guide 120 is an appendage extending from the periphery of opening 118. Hook guide 120 is, illustratively, configured to extend into cavity 34 of magazine 32, and within channel 122 between carrier portions 43, 43'. Guide 120 comprises an arcuate guiding surface 196 to urge any paint ball located in a space 38 (see FIG. 3) to move into firing chamber 17 through openings 116, 118. (See, also, FIG. 8.) Movement of the paint ball is indicated by arrow 197. In addition, the opening 118 is illustratively shown to have a countersunk portion 198 to further assist carrying a paint ball into chamber 17. (See, also, FIG. 3.) In one illustrative embodiment, opening 118 is disposed through an accessory mount 201 that attaches to a corresponding portion of gun 1. (See, also, FIG. 1.)

Another illustrative embodiment of a paint ball feed system is also incorporated in FIGS. 1 through 7 and 9. This embodiment is a forced load feed mechanism. As shown in FIG. 1 and previously discussed, extending from cylinder 12 opposite rod 54 is rod 18 with strike pad 16 attached thereto. The reciprocating handle 6 is attached to a cylindrically-reciprocating member 14 located in the firing chamber 17 and extends through slot 8. As previously discussed, reciprocating handle 6 is configured to move reciprocally within slot 8. As gun 1 fires, forces produced from the compressed air and/or a bias member moves reciprocating member 14 in direction 210. It is contemplated that reciprocating member 14 may be further configured to move back in direction 212. Such is described in U.S. Pat. No. 5,722,383, entitled "Impeder for a Gun Firing Mechanism with Ammunition Feeder and Mode Selector," the complete disclosure of which is herein incorporated by reference. As shown in FIG. 2, movement of reciprocating member 14 moves handle 6 concurrently. This movement of handle 6 causes same to strike pad 16, forcing rod 18, piston 108, and rod 54 to move in direction 62 during its forward stroke, thereby actuating advance assembly 52 as otherwise previously described. (See also FIG. 5.) It is appreciated in this embodiment, however, that the force required to move piston 108 is not supplied by fluid entering cylinder 12 from ports 4, 50 and tube 10. It is further appreciated that in another illustrative embodiment, handle 6 and pad 16 may be coupled together or integrally formed, rather than being spaced apart structures, as illustratively shown in FIG. 1. It is also appreciated that other means of driving piston 108 is contemplated, including, but not limited to, a motor.

Another illustrative embodiment of a paint ball feed system is similarly incorporated and shown in FIGS. 1 through 7 and 9. This embodiment is a manually-forced, automatic paint ball feed system. Such a feed system operates similar to the previously described forced load feed mechanism, but for the use of handle 6. (See FIGS. 1 and 2.) It is contemplated that an operator can manually push strike pad 16 in direction 210, thereby moving piston 108 and rod 54 in direction 62, thereby actuating advance assembly 52 as otherwise previously disclosed. (See FIG. 5.) The paint ball is then automatically fed into chamber 17, as also previously disclosed. In this embodiment, however, the operator can dictate when a new paint ball will be loaded, rather than such occurring every time the gun is fired, as is illustratively the case with the previous embodiments.

As with virtually all feeder mechanisms configured to deposit a paint ball through a relatively small opening and into a firing chamber, there is a possibility of that paint ball becoming misfed or jammed. This prevents the paint ball from properly entering the firing chamber. Illustratively, the paint ball can be blocked from entering the firing chamber by another paint ball, or by structures within the magazine, or the magazine itself. It is appreciated that such manners in which a paint ball can be jammed or misfed is known by those skilled in the art.

Figure 11:
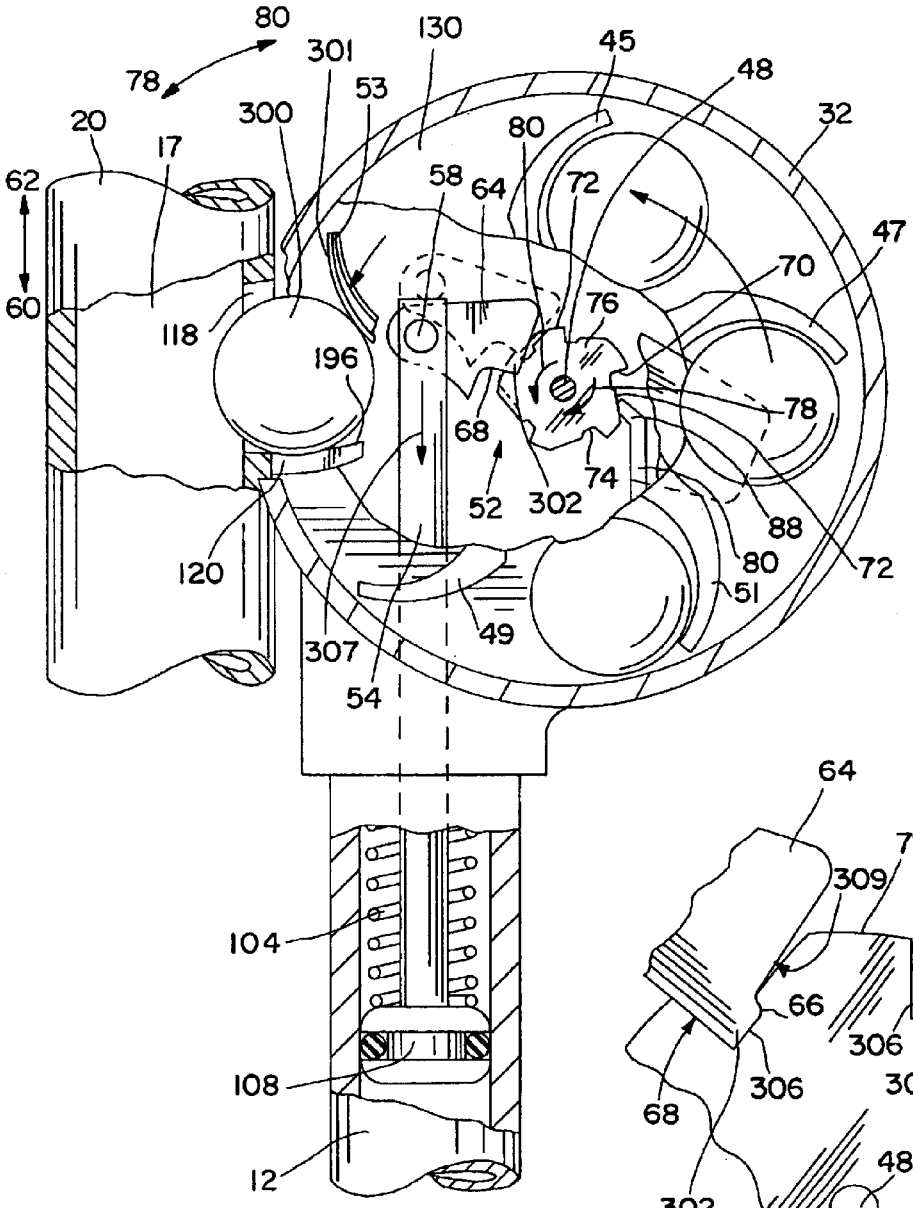
FIG. 11 is a top detail view of an embodiment of a feed mechanism showing an illustrative paint ball illustratively misfed such that it is prevented from being deposited properly in the firing mechanism.
Figure 12:
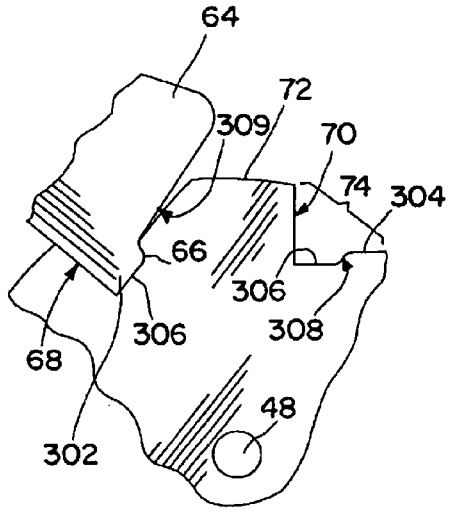
FIG. 12 is a detail view of a portion of the feed assembly of FIG. 11.

An illustrative embodiment of a feed mechanism assembly is shown in FIGS. 11 and 12 which is configured to dislodge a misfed paint ball so that it can be properly deposited into the firing mechanism of the paint ball gun. As shown in FIG. 11, the nature of the jam or misfeed, for illustrative purposes, is paint ball 300 wedged between surface 301 of paddle 53 and surface 196 of hook guide 120. Additionally, such misfed paint balls are often wedged against the edge 305 (see FIG. 11) or other proximal surface surrounding chamber opening 118. (The cutaway depiction in FIG. 11 prevents paint ball 300 from being shown wedged against edge 305.) In this illustrative embodiment, during the normal course of firing, as previously described, paint ball 300 may become inadvertently raised from flooring 130, causing it to not fit through opening 118. As paint ball gun 1 is fired, fluid in chamber 110 or manual exertion on piston 108 in cylinder 12 causes rod 54 to move in direction 62, describing the forward stroke. Such movement of rod 54 causes base member 56 to move about pivot member 58 in direction 78. Pawl 64 on base member 56 slides past surface 72 of wheel 76 as spring rod 82 engages one of the notches 74 of wheel 76, preventing same from rotating. Under normal circumstances, pursuant the illustrative embodiment, engaging surface 68 of pawl 64 engages surface 70 of wheel 76, rotating same in direction 80 when spring member 104 causes rod 54 to move in direction 60 during the return stroke which normally causes feed mechanism 2 to deposit a paint ball into firing chamber 17, as previously described herein. If, however, a paint ball becomes jammed, like the misfed paint ball 300 or another ball in the magazine or hopper, rod 54 is prevented from completing its return stroke in direction 60 to cause ball carrier assembly 36 from depositing the paint ball in firing chamber 17. In this illustrative example, pawl 64, drawn in phantom in FIG. 11, and the partial return stroke indicated by directional arrow 307 is the condition created because paint ball 300 is wedged between surface 301 and 196, for example, limiting the ability of ball carrier assembly 36 to properly move in direction 80. At this point, rod 54, pawl 65, and wheel 76 no longer move, being stationary in mid return stroke 307. It is appreciated that the bias created by spring member 104, which causes pressure on paint ball 300 by paddle 53, will not be sufficient to rupture paint ball 300.

In this illustrative example, it is contemplated that the paint ball may be cleared by re-engaging advance assembly 52, causing ball carrier assembly 36 to move to clear the paint ball. Illustratively, refiring the paint ball gun 1 will cause fluid in chamber 110 or manual exertion on piston 108 which is held in the mid return stroke 307. The pressure causes rod 54 to move back in direction 62. Again, such movement of rod 54 causes base member 56 to move about axle 48 in direction 78.

As described with respect to previous embodiments, under an illustrative normal operation of feed mechanism 2, pawl 64 on base member 56 will slide past surface 72 of wheel 76 as spring rod 82 engages one of the notches 74 of wheel 76, preventing same from rotating during forward stroke in direction 62. In this illustrative example, however, because rod 54 is illustratively held in the partial return stroke, a tooth 302 which is located on the periphery 309 of pawl 64, as shown in FIG. 12, engages a detent 306 disposed in notch 74. These illustrative structures 302 and 306 engage to move wheel 76 in direction 78, contrary to normal operation of advance assembly 56 which moves wheel 76 only in direction 80. Specifically in this illustrative embodiment, tooth 302 engages surface 308, directing the force which causes rod 54 when moving in direction 62 to also cause wheel 76 to move in direction 78. A contributing factor is the position the pawl 64 is held at during the partial return stroke 307. Specifically, the pawl end 88 of spring rod 82 is located adjacent surface 72 of wheel 76, rather than engaging surface 70 of notch 74, as shown in FIG. 11. This allows wheel 76 to be moved, or illustratively rotated in direction 78 without interference from spring rod 82, which normally prevents such movement during the forward stroke of rod 54 in direction 62 of rod 54. Additionally, the position where tooth 302 or pawl 64 engages detent 306 of notch 74 while assembly 54 is in mid return stroke 307, allows the movement of pawl 64 in direction 78 to move wheel 76 in direction 78 as well, rather than sliding past notch 74.

Because of the connection between advance assembly 52 and ball carrier assembly 36, previously described herein, ball carrier assembly 36 too moves in direction 78. This causes the paddles 45, 47, 49, 51, 53 to illustratively move in a direction opposite of the direction typically traveled to deposit the paint ball into firing chamber 17. This movement, thus, relaxes at least some force otherwise being exerted on paint ball 300, as shown in FIG. 11, or another paint ball in another location that might be causing the misfeed. In the illustrative example of paint ball 300, the movement of paddle 53 results in paint ball 300 repositioning itself with respect to opening 118.

Once advance assembly 52 and ball carrier assembly 36 complete moving in direction 78 to reposition paint ball 300 from the forward stroke of rod 54, assemblies 52 and 36 will return moving in direction 80, resulting from rod 54 moving in direction 62, similar to that of previous embodiments, and the bias of spring member 104 will cause engaging surface 68 of pawl 64 to engage surface 70 of wheel 76, rotating same in direction 80. This causes ball carrier assembly 36 to deposit either the once misfed paint ball 300 or another paint ball into opening 118 and firing chamber 17 as described previously herein in regards to other embodiments. (See FIG. 2, for example.)

It is contemplated that the particular manner and location in which FIG. 11 depicts a misfed paint ball 300 is for illustrative purposes. It is appreciated that other ways exist with which a paint ball can be misfed or jammed within the magazine or hopper, known by those skilled in the art, and clearing such a misfed or jammed paint ball is contemplated by the feed mechanism disclosed herein. It is also contemplated that illustrative structures 302 and 306 may be substituted with other suitable structures that have the effect of moving the ball carrier assembly to clear the misfed paint ball.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A paint ball gun comprising:

an actuator coupled to the paint ball gun configured to advance in coordination with the paint ball gun being fired;

a paint ball advance assembly coupled to the actuator that moves in response to movement by the actuator;

a bias member engageable with the actuator to create a return force on the actuator to move the actuator opposite the direction of the advance; and a paint ball feed assembly in operable communication with the paint ball advance assembly and which engages the paint ball to feed the paint ball into the paint ball gun when the bias member moves the actuator opposite the advance which moves the paint ball advance assembly.

2. The paint ball gun of claim 1, wherein an engaging member extends from the paint ball gun and is caused to move by firing the paint ball gun, the engaging member also being engageable with the actuator to advance the actuator as the engaging member moves.

3. The paint ball gun of claim 1, wherein the paint ball feed assembly comprises a priming member attached to the paint ball advance assembly.

4. The paint ball gun of claim 3, wherein the paint ball feed assembly comprises a load member assembly attached to the paint ball advance assembly such that the load member assembly loads a paint ball into the paint ball gun.

5. The paint ball gun of claim 4, wherein the load member assembly comprises a plurality of spaced apart coaxially aligned extending members.

6. The paint ball gun of claim 1, wherein the paint ball advance assembly being a ratchet assembly.

7. The paint ball gun of claim 6, wherein the ratchet assembly comprises a wheel in communication with paint ball fee assembly, a first pawl to communicate motion from a piston to the a wheel, and a second pawl to selectively prevent motion of the wheel.

8. A paint ball gun comprising:

a chamber attached to the paint ball gun;

a piston disposed in the chamber;

a spring member in communication with the piston to bias the piston in a first direction;

a fluid source to provide a force against the piston in a second direction that opposes the first direction;

a reciprocating lever coupled to the piston, the lever comprising a pawl;

a wheel having a plurality of teeth disposed thereon configured to receive the pawl of the reciprocating lever such that as the piston moves in the second direction the pawl engages one of the plurality of teeth to cause the wheel to rotate in a first rotational direction;

a spring pawl that engages another of the plurality of teeth to prevent rotation of the wheel in a second rotational direction, which is opposite the first rotational direction, when the piston is moving in the second direction;

a paint ball guide member coupled to the wheel, the paint ball guide configured to feed a paint ball into the paint ball gun;

wherein fluid from the fluid source enters the chamber moving the piston in the second direction causing the pawl of the reciprocating lever to engage one of the plurality of teeth of the wheel; and wherein the bias of the spring member moves the piston in the first direction such that the engagement between the pawl and one of the plurality of teeth moves the wheel in the first rotational direction to cause the guide member to move to feed the paint ball into the paint ball gun.

9. A paint ball gun, the paint ball gun comprising an automatic paint ball feed mechanism, the automatic paint ball feed mechanism comprising:

a chamber attached to the paint ball gun;

a piston disposed in the chamber and being movable within the chamber in first and second directions, the second direction being opposite the first direction;

a ratchet mechanism is coupled with the piston; and a paint ball guide member coupled to the ratchet mechanism, the paint ball guide configured to feed a paint ball into the paint ball gun;

wherein a force acts on the piston moving the piston in the second direction to engage the ratchet mechanism and after depletion of the force the piston moves in the first direction to cause the paint ball guide member to move and feed the paint ball into the paint ball gun.

10. The paint ball gun of claim 9, wherein the paint ball guide member comprises a priming member coupled to the ratchet assembly.

11. The paint ball gun of claim 10, wherein the paint ball guide member comprises a load member assembly.

12. The paint ball gun of claim 11, wherein the load member assembly comprises a plurality of spaced apart paddles.

13. The paint ball gun of claim 9, wherein the ratchet mechanism comprises a wheel in communication with the paint ball feed assembly, a first pawl to communicate motion from a piston to the wheel, and a second pawl to selectively prevent motion of the wheel.

14. A paint ball gun, the paint ball gun comprising an automatic paint ball feed mechanism, the automatic paint ball feed mechanism comprising:

a magazine attached to the paint ball gun and configured to contain at least one paint ball;

wherein the magazine is in operable communication with a firing mechanism portion of the paint ball gun by an opening adjacent both the magazine and the firing mechanism; and a ball guide member coupled to the gun and extending therefrom and into the magazine to direct the paint ball into the firing mechanism through the opening.

15. The paint ball gun of claim 14, wherein the magazine comprises a plurality of paddle assemblies, the assemblies being coaxially aligned.

16. The paint ball gun of claim 15, wherein the plurality of paddles having a space between at least a pair of the plurality of paddles, the space configured to receive the ball guide member.

17. The paint ball gun of claim 14, wherein the magazine comprises a plane flooring at its lowermost extent.

18. A paint ball gun, the paint ball gun comprising an automatic paint ball feed mechanism, the automatic paint ball feed mechanism comprising:

a magazine having a paddle wheel assembly configured to move at least one paint ball into the paint ball gun;

wherein the paddle wheel assembly comprises a plurality of coaxially aligned paddle members;

wherein each of the plurality of paddle members comprises at least two paddle blades;

wherein the paint ball gun comprises a ball guide member that guides a paint ball moved by the paddle wheel assembly; and wherein the plurality of paddle members have a space between at least a pair of the plurality of paddle members, the space configured to receive the ball guide member.

19. The paint ball gun of claim 18, wherein the magazine comprises a plane flooring adjacent one of the plurality of paddle members.

20. A paint ball gun, the paint ball gun comprising an automatic paint ball feed mechanism, the automatic paint ball feed mechanism comprising:

a reciprocating lever comprising a pawl;

a wheel having a plurality of teeth disposed thereon to receive the pawl of the reciprocating lever such that as the lever moves in a second direction the pawl engages one of the plurality of teeth to cause the wheel to rotate in a first rotational direction;

a spring pawl that engages another of the plurality of teeth to prevent rotation of the wheel in a second rotational direction, which is opposite the first rotational direction;

a center post extending from the wheel;

a paint ball guide member coupled to the center post, the paint ball guide configured to feed a paint ball into the paint ball gun.

21. A misfed paint ball clearing apparatus operable to clear a misfed paint ball in a paint ball gun by allowing the misfed paint ball to be deposited in a firing chamber of the paint ball gun, the misfed paint ball clearing apparatus comprising:

an advance assembly;

an actuator;

wherein motion of the actuator drives the advance assembly; and a feed assembly;

wherein driving of the advance assembly causes concurrent movement of the feed assembly; and wherein concurrent movement of the feed assembly affects the misfed paint ball's position with respect to the paint ball gun to cause the misfed paint ball to deposit in the firing chamber of the paint ball gun.

22. The misfed paint ball clearing apparatus of claim 21, wherein the actuator further comprises a piston arm.

23. The misfed paint ball clearing apparatus of claim 21, wherein the advance assembly is a ratchet system.

24. The misfed paint ball clearing apparatus of claim 23, wherein the ratchet system comprises a wheel having a plurality of notches disposed thereon, a pawl engageable with the wheel to rotate the wheel, and a stop selectively engageable with the wheel to prevent rotation of the wheel.

25. The misfed paint ball clearing apparatus claim 24, wherein the pawl further comprises a tooth that extends from the pawl.

26. The misfed paint ball clearing apparatus of claim 25, wherein at least one of the plurality of notches has a detent disposed therein.

27. The misfed paint ball clearing apparatus of claim 26, wherein the tooth selectively engages the detent.

28. The misfed paint ball clearing apparatus of claim 21, wherein the feed assembly further comprises at least one paddle which affects the misfed paint ball's position with respect to the paint ball gun to cause the misfed paint ball to deposit in the firing chamber of paint ball gun.

29. The misfed paint ball clearing apparatus of claim 21, further comprising a trigger mechanism that selectively engages the actuator to initiate motion of the actuator.

30. The misfed paint ball clearing apparatus of claim 29, wherein motion of the actuator is in a first linear direction, and concurrent movement of the feed assembly is in a first rotational direction.

31. The misfed paint ball clearing apparatus of claim 30, wherein concurrent movement of the feed assembly in the first rotational direction affects the misfed paint ball's position with respect to the paint ball gun.

32. The misfed paint ball clearing apparatus of claim 31, wherein a movement of the feed assembly in a second rotational direction causes the misfed paint ball to deposit in the firing chamber of the paint ball gun.

33. A paint ball gun having a misfed paint ball clearing apparatus which comprises:

a container positioned adjacent an opening disposed in the paint ball gun;

wherein the opening provides operable communication between the container and an interior portion of the paint ball gun;

an extending member positioned within the container;

wherein the extending member is movable in a first direction to affect a paint ball's position relative to the container, wherein the paint ball would otherwise be prevented from entering the opening disposed in the paint ball gun; and wherein the extending member is movable in a second direction to deposit the paint ball into the opening disposed in the paint ball gun.

34. The misfed paint ball clearing apparatus of claim 33, wherein the first direction in which the extending member is movable is a first rotational direction.

35. The misfed paint ball clearing apparatus of claim 34, wherein the second direction in which the extending member is movable is a second rotational direction.

36. The misfed paint ball clearing apparatus of claim 33, wherein the extending member engages the paint ball, which is misfed relative to the opening, to move the paint ball to another position relative to the container, and re-engage the paint ball to deposit the paint ball into the opening.

37. The misfed paint ball clearing apparatus of claim 33, wherein the first and second rotational directions are opposed directions.

38. A method for clearing a misfed paint ball in a paint ball gun wherein the paint ball is misfed relative to a feed mechanism attached to the paint ball gun and is prevented from entering a firing chamber of the paint ball gun, wherein the feed mechanism otherwise deposits a paint ball into the firing chamber, the method for clearing the misfed paint ball comprising the steps of:

powering an actuator;

engaging the advance assembly by the actuator to cause the advance assembly to move;

driving the feed mechanism by engagement with and movement of the advance assembly; and clearing the misfed paint ball by driving the feed mechanism which affects a positional adjustment of the misfed paint ball relative to the firing chamber to reposition the paint ball to a location that allows the misfed paint ball to be deposited into the firing chamber.

39. The method of claim 38, further comprising the steps of activating a trigger mechanism to initiate powering of the actuator.

40. The method of claim 39, further comprising the steps of moving the advance assembly in a first direction.

41. The method of claim 40, further comprising the steps of moving the feed mechanism in the first direction concurrently with moving the advance assembly in the first direction.

42. The method of claim 41, further comprising the steps of affecting the positional adjustment of the misfed paint ball by moving the feed mechanism in the first direction, wherein the misfed paint ball is repositioned to a location that allows the misfed paint ball to be deposited into the firing chamber.

43. The method of claim 42, further comprising the steps of moving the advance assembly in a second direction.

44. The method of claim 43, further comprising the steps of moving the feed mechanism in the second direction concurrently with moving the advance assembly in the second direction.

45. The method of claim 44, further comprising the steps of moving the misfed paint ball that is able to enter the firing chamber by moving the feed assembly in the second direction, and depositing the misfed paint ball into the firing chamber.

46. A method for clearing a misfed paint ball in a paint ball gun wherein the paint ball is misfed relative to a feed assembly attached to the paint ball gun and is prevented from entering a firing chamber of the paint ball gun, wherein the feed mechanism otherwise deposits a paint ball into the firing chamber, the method for clearing the misfed paint ball comprising the steps of:

activating a trigger mechanism;

powering an actuator to cause linear movement of the same by activation of the trigger mechanism;

engaging an advance assembly by the linear movement of the actuator;

rotating a portion of the advance assembly by translating the linear movement of the actuator into rotational movement; and clearing the misfed paint ball by rotating the feed assembly concurrently with rotating the advance assembly which affects a positional adjustment of the misfed paint ball relative to the firing chamber to reposition the paint ball to a location that allows the misfed paint ball to be deposited into the firing chamber.

47. The method of claim 46, wherein the advance assembly is a ratchet assembly.

48. The method of claim 47, wherein the ratchet assembly comprises a wheel having a plurality of notches disposed thereon, a pawl engageable with at least one of the notches disposed on the wheel to effect rotation of the wheel, and a stop selectively engageable with the wheel to selectively prevent rotation of the wheel.

49. The method of claim 48, wherein the pawl selectively engages at least one of the plurality of notches to rotate the wheel in a forward direction.

50. The method of claim 49, wherein the pawl further comprises a tooth that extends from the pawl.

51. The method of claim 50, wherein at least one of the plurality of notches has a detent disposed therein.

52. The method of claim 51, wherein the tooth selectively engages the detent.

53. The method of claim 52, further comprising the steps of rotating the wheel in a reverse direction by the tooth which engages the detent.

54. The method of claim 53, wherein the reverse direction is opposite the forward direction.

55. The method of claim 54, wherein rotation of the wheel in the reverse direction causes movement of the feed assembly in the reverse direction to deposit the paint ball into the firing chamber.

56. The method of claim 53, wherein rotation of the wheel in the forward direction causes movement of the feed assembly in the forward direction which affects a positional adjustment of the misfed paint ball relative to the firing chamber to reposition the paint ball to a location that allows the misfed paint ball to be deposited into the firing chamber.

* * * * *